US007028376B2

(12) United States Patent
Mattesky

(10) Patent No.: US 7,028,376 B2
(45) Date of Patent: Apr. 18, 2006

(54) DEVICE FOR LOADING MERCHANDISE ONTO PEGBOARD DISPLAY

(75) Inventor: Henry Mattesky, Ramsey, NJ (US)

(73) Assignee: Magla Products, L.L.C., Morristown, NJ (US)

( * ) Notice: Subject to any disclaimer, the term of this patent is extended or adjusted under 35 U.S.C. 154(b) by 52 days.

(21) Appl. No.: 10/116,719

(22) Filed: Apr. 3, 2002

(65) Prior Publication Data

Related U.S. Application Data

(63) Continuation-in-part of application No. 09/402,861, filed as application No. PCT/US98/07306 on Apr. 9, 1998, now Pat. No. 6,446,819.

(60) Provisional application No. 60/281,083, filed on Apr. 3, 2001, provisional application No. 60/042,832, filed on Apr. 9, 1997.

(51) Int. Cl.

| | |
|---|---|
| ***A44B 21/00*** | (2006.01) |
| ***B65D 63/00*** | (2006.01) |
| ***G90F 3/18*** | (2006.01) |
| ***G90F 23/00*** | (2006.01) |

(52) U.S. Cl. ..... 24/16 PB; 24/17 R; 24/30.5 P; 299/142; 299/158; 211/57.1

(58) Field of Classification Search ..... 24/16 PB, 24/20.5 R, 30.5 P, 30 W; 204/140, 141, 204/142, 153, 156, 158; 211/57.1; 206/493; 53/399

See application file for complete search history.

(56) References Cited

U.S. PATENT DOCUMENTS

| | | | | |
|---|---|---|---|---|
| 216,923 | A | | 6/1879 | White |
| 328,888 | A | | 10/1885 | Hunt |
| 859,199 | A | * | 7/1907 | Anderton ..... 40/563 |
| 868,286 | A | | 10/1907 | Munday |
| 1,478,112 | A | | 12/1923 | Flather |
| 1,702,987 | A | | 2/1929 | Wilson |
| 1,711,070 | A | | 4/1929 | Suydam, Jr. |
| 1,984,589 | A | * | 12/1934 | Ludy ..... 24/16 PB |
| 2,016,059 | A | * | 10/1935 | Stevens ..... 40/668 |
| 2,153,227 | A | | 4/1939 | Allstatter |
| 2,314,779 | A | * | 3/1943 | Fuhrmann ..... 24/16 PB |
| 2,511,431 | A | | 6/1950 | Dashkin et al. |
| 2,554,105 | A | | 5/1951 | Heinle |
| 2,710,409 | A | | 6/1955 | Burandt |
| 2,967,611 | A | | 1/1961 | Bolinger |
| 3,130,462 | A | * | 4/1964 | Mitchell ..... 24/16 PB |
| 3,148,770 | A | | 9/1964 | Costman |
| 3,211,293 | A | | 10/1965 | Tarnoff |
| 3,255,501 | A | * | 6/1966 | Laguerre ..... 24/16 PB |
| 3,313,407 | A | | 4/1967 | Palm, Jr. |
| 3,402,435 | A | | 9/1968 | Merser |
| 3,543,353 | A | | 12/1970 | Meehan |
| 3,597,803 | A | | 8/1971 | Van Neil |

(Continued)

FOREIGN PATENT DOCUMENTS

| | | |
|---|---|---|
| CH | 388759 | 6/1965 |

(Continued)

*Primary Examiner*—Robert J. Sandy
(74) *Attorney, Agent, or Firm*—McCarter & English, LLP

(57) ABSTRACT

The present invention relates to a device for holding and facilitating the unloading therefrom of packaged merchandise onto a display peg. The device includes a gathering mechanism for gathering together a group of packages such that hanging holes provided in individual packages are aligned so as to permit the gathered packages to be applied to a display peg together with the device.

24 Claims, 13 Drawing Sheets

U.S. PATENT DOCUMENTS 3,638,801 A 2/1972 Larson
3,913,178 A 10/1975 Ballin
3,952,872 A 4/1976 Consiglio, Jr.
4,072,232 A 2/1978 Marsman et al.
4,111,297 A 9/1978 Paulin
4,143,772 A 3/1979 Bona
4,149,329 A 4/1979 Graves
4,301,575 A 11/1981 Goldberg
4,474,300 A 10/1984 Entis
4,476,983 A 10/1984 Fast
4,477,950 A * 10/1984 Cisek et al. ..... 24/30.5 P
4,510,649 A 4/1985 Yudis et al.
4,542,827 A 9/1985 Pilzer
4,558,896 A * 12/1985 Farnworth ..... 294/156
4,570,368 A 2/1986 Stover
4,624,060 A 11/1986 Maxwell
4,630,384 A 12/1986 Breen
4,823,964 A 4/1989 Lundberg
4,877,068 A 10/1989 Blake
4,901,403 A * 2/1990 Larsen ..... 24/16 PB
4,910,835 A * 3/1990 Carpenter ..... 24/16 PB
4,942,644 A * 7/1990 Rowley ..... 24/16 PB
5,014,957 A 5/1991 Nichol, Jr.
5,054,727 A 10/1991 Campbell et al.
5,096,248 A * 3/1992 Ryan ..... 294/156
5,112,014 A 5/1992 Nichols
5,189,761 A * 3/1993 Chisholm ..... 24/16 PB
5,193,676 A 3/1993 Gold
5,222,608 A 6/1993 Eklof et al.
5,234,245 A * 8/1993 Peterson et al. ..... 294/158
5,261,175 A 11/1993 Gebka
5,531,417 A 7/1996 Valiulis et al.
5,553,706 A 9/1996 Gold
5,573,152 A * 11/1996 Arnold ..... 224/148.4
5,584,103 A 12/1996 Slavin
5,632,387 A 5/1997 Johnson
5,678,794 A 10/1997 Kump
5,718,340 A 2/1998 Nagel
5,730,296 A 3/1998 Limmer
5,878,520 A * 3/1999 Milbrandt et al. ..... 24/16 PB
5,901,860 A 5/1999 Nowicki
5,988,373 A 11/1999 Yates
6,058,639 A 5/2000 Tinklenberg et al.
6,062,622 A * 5/2000 Susman et al. ..... 24/16 PB
6,131,748 A 10/2000 Kawasaki et al.
6,164,617 A 12/2000 Butterfield et al.
6,226,911 B1 5/2001 Wescombe
6,364,134 B1 4/2002 Christy
6,401,304 B1 * 6/2002 Dossett ..... 24/16 PB
6,446,819 B1 9/2002 Mattesky

FOREIGN PATENT DOCUMENTS

CH 400782 4/1966
EP 0093988 11/1983
FR 2216767 8/1974
FR 2655021 5/1991
WO 9844831 10/1988
WO 8906820 7/1989

* cited by examiner

DEVICE FOR LOADING MERCHANDISE ONTO PEGBOARD DISPLAY

CROSS-REFERENCE TO RELATED APPLICATIONS

This is a continuation-in-part of U.S. application Ser. No. 09/402,861, filed Jan. 24, 2000, now U.S. Pat. No. 6,446,819, which is a U.S. national phase application corresponding to International Patent Application No. PCT/US98/07306, filed Apr. 9, 1998, published Oct. 15, 1998 in the English language and claiming the benefit of U.S. Provisional Application No. 60/042,832 filed Apr. 9, 1997. This application also claims the benefit of U.S. Provisional Application Ser. No. 60/281,083 filed Apr. 3, 2001.

FIELD OF THE INVENTION

The present invention relates to devices for displaying packaged merchandise and, more particularly, to devices for loading packaged merchandise onto pegboard displays.

BACKGROUND OF THE INVENTION

Pegboard displays have been popular in the retail industry for displaying lightweight merchandise. Typically, merchandise packages are loaded individually onto pegboard displays. As a result, the conventional loading method is inefficient and time-consuming. Given the narrow profit margin on which most retail outlets operate, cost saving in this activity is desirable.

A recent solution to the problem mentioned above has been the "power panel". The "power panel" is a ready made package of a number of loaded pegs in a box, which is simply hung up on a shelf wall. This displaying method has disadvantages in that it is expensive and does not provide means of recharge if there is a substantial difference in the sale of different items in the panel.

Various devices have also been developed for facilitating the loading of merchandise onto a display peg. For instance, U.S. Pat. No. 4,143,772 discloses a device having a plug which connects by a cord through a rear hole of a cup-shaped coupler. The plug and coupler can be joined together to form a loop that holds merchandise. The coupler can be separated from the plug and connected to the end of a display peg, so that the merchandise can slide onto the peg. Because the device needs to be uncoupled prior to the loading of the merchandise onto a display peg, the merchandise loading process is made rather complicated and/or inefficient.

SUMMARY OF THE INVENTION

The present invention overcomes the disadvantages and shortcomings of the prior art discussed above by providing a new and improved device for holding and facilitating the unloading therefrom of packaged merchandise onto a display peg. More particularly, the device includes a gathering mechanism for gathering together a group of packages such that hanging holes provided in individual packages are aligned so as to permit the gathered packages to be applied to a display peg together with the device. In accordance with the present invention, the gathered mechanism can include an open loop or a closed loop.

BRIEF DESCRIPTION OF THE DRAWINGS

For a better understanding of the present invention, reference is made to the following detailed description of exemplary embodiments, considered in conjunction with the accompanying drawings, in which.

DETAILED DESCRIPTION OF THE INVENTION

Figure 1:
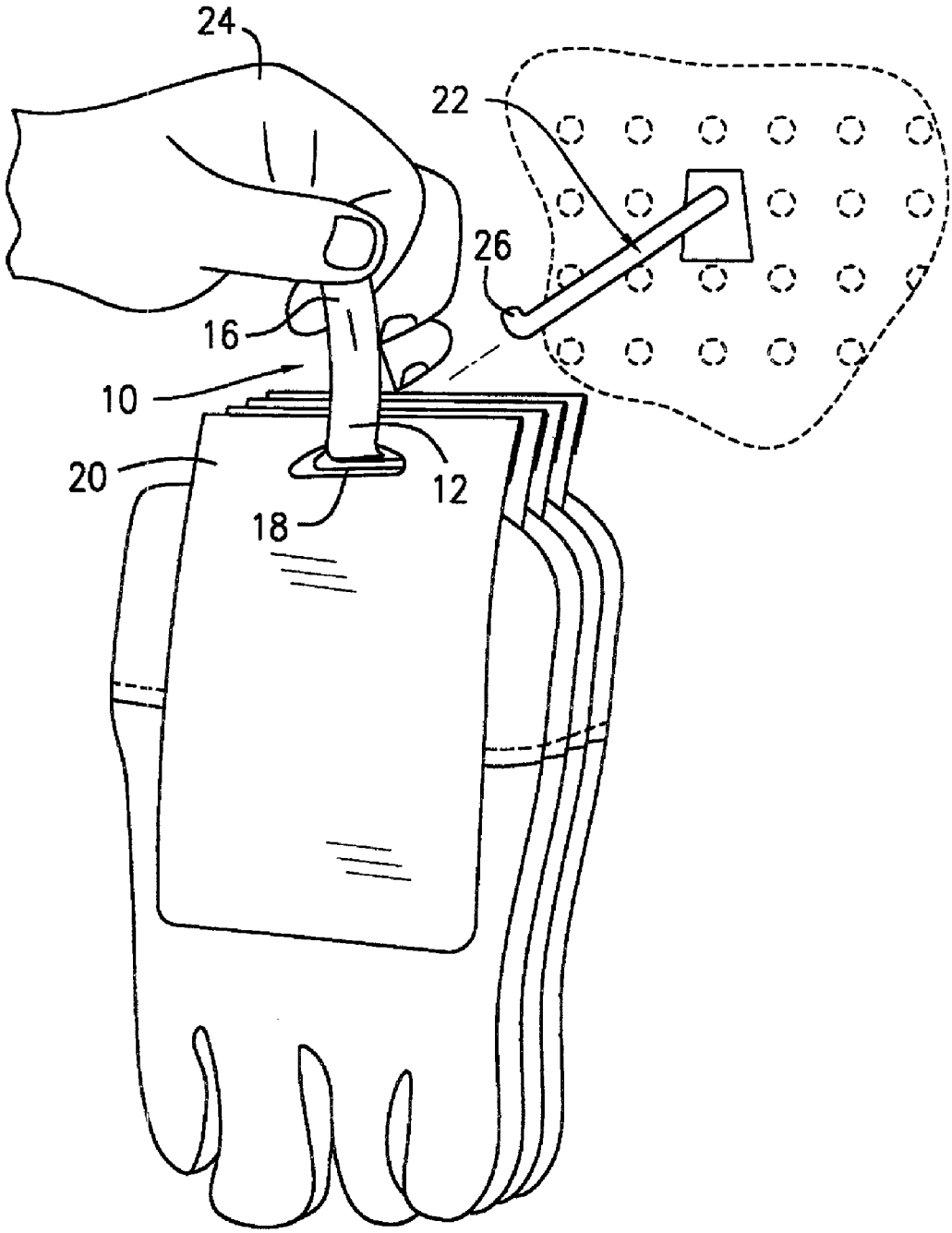
FIG. 1 is a schematic view of a merchandise loading device constructed in accordance with a first embodiment of the present invention prior to the loading of merchandise packages onto a peg hook.
Figure 2:
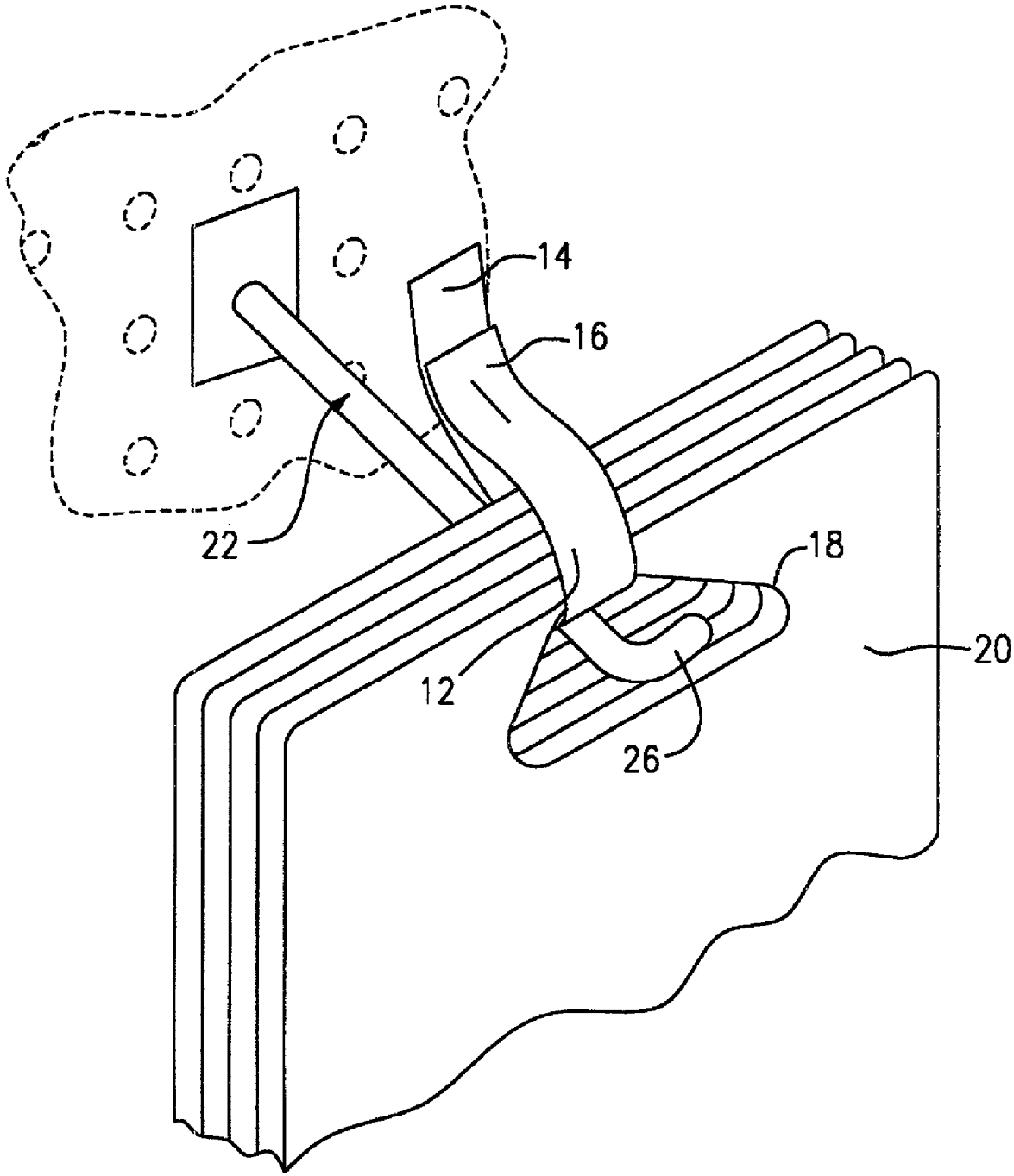
FIG. 2 is a schematic view of the loading device shown in FIG. 1 subsequent to the loading of the packages onto the peg hook.

Referring to FIGS. 1 and 2, there is shown a merchandise loading/unloading device 10 constructed in accordance with a first embodiment of the present invention. The loading device 10 includes a band or strip 12 having a pair of ends 14, 16. The end 14 of the band 12 is threaded or otherwise inserted through hanging holes 18 of merchandise packages 20 so as to tie the packages 20 together as a single assembly or unit. More particularly, the packages 20 are tied together by the band 12 such that the holes 18 are aligned substantially linearly and are arranged (i.e., ganged up) adjacent to one another. The end 16 of the band 12 is securely attached (e.g., stapled) to the end 14 so as to form a closed loop for maintaining the packages 20 as a unit.

In use, the packages 20 are pre-assembled as a unit by the band 12 and then shipped to a retail outlet or store. In order to load the packages 20 onto a peg hook 22 at the retail outlet, with the band 12 held by a hand 24 of a user (see FIG. 1), the holes 18 of the packages 20 are aligned with a free end 26 of the peg hook 22. The free end 26 of the peg hook 22 is then inserted through the holes 18 of the packages 20 by pulling the band 12 and hence the entire package unit toward a rear end of the peg hook 22 (see FIG. 2). This loading operation is facilitated by the band 12, which functions to guide the packages 20 onto the peg hook 22. After all of the packages 20 are loaded onto the peg hook 22, the band 12 is disabled (e.g., cut, torn or pierced) and then removed, thereby releasing the packages 20 from one another to be dispensed individually from the peg hook 22.

It should be appreciated that the present invention provides numerous advantages over the prior art discussed above. For instance, because the packages 20 are gathered together as a single assembly (i.e., the holes 18 of the packages 20 are aligned and ganged together) and then shipped to a retail outlet, loading of the packages 20 onto the peg hook 22 can be achieved in a simple and efficient manner. That is, the free end 26 of the peg hook 22 is aligned with the holes 18 of the packages 20 and is then inserted therethrough in a substantially single motion or step. Moreover, because only the band 12 is used for quick and easy loading of the packages 20, the present invention provides a cost-effective loading method.

Figure 3:
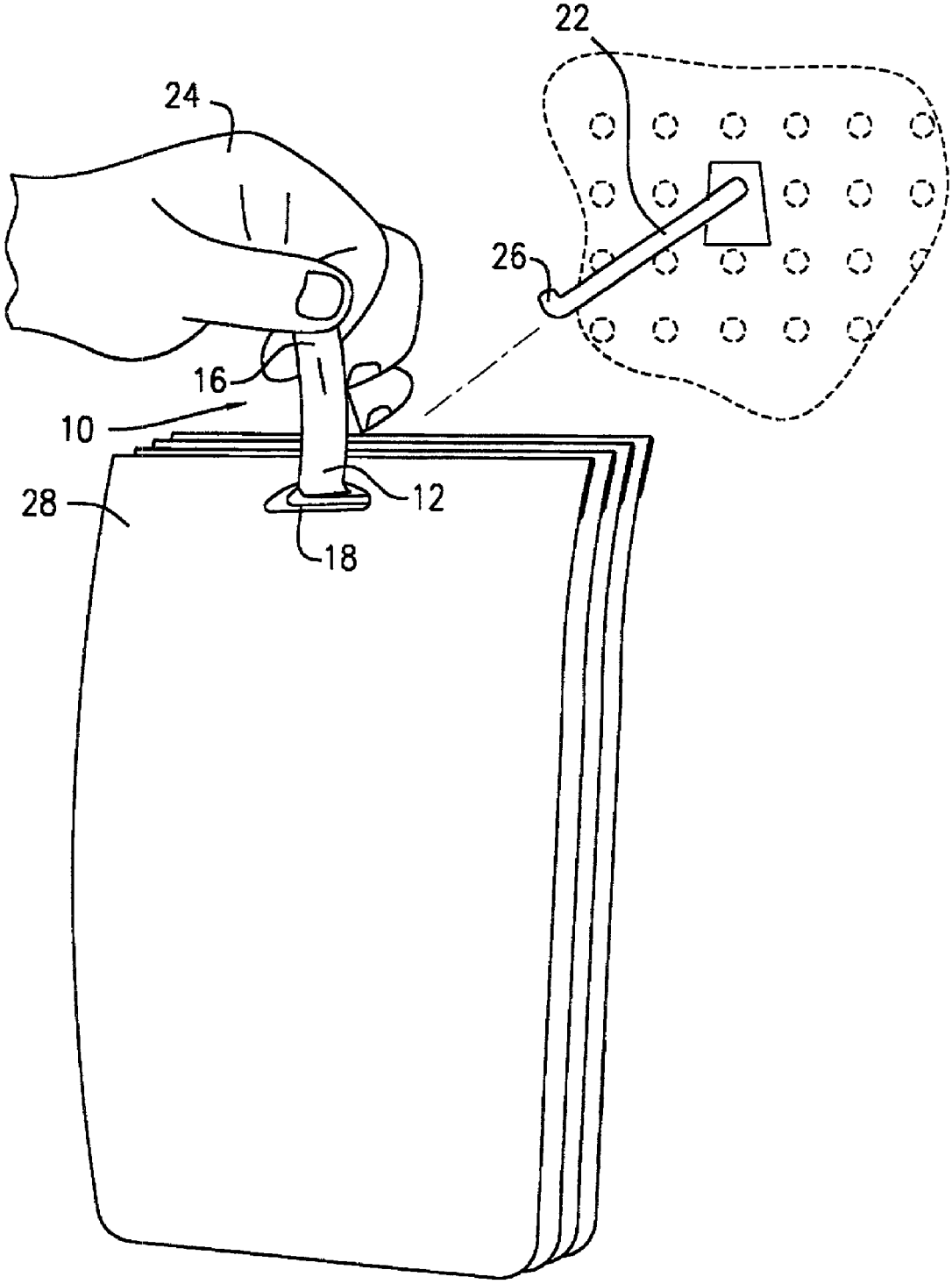
FIG. 3 is a schematic view illustrating the use of the loading device shown in FIGS. 1 and 2 in connection with a different type of package.

It should be noted that the present invention can have numerous modifications and variations. For instance, the band 12 can be replaced with any fastening members, such as links, cables, ropes, fasteners, clips, etc. In such circumstances, as used herein, the term "band" shall mean to include any such fastening members. The band 12 can also be made from a number of materials (e.g., metal or non-metal wires, plastic films, cardboard or paper bands). In this regard, it is noted that such fastening members can be designed to maintain the holes 18 of the packages 20 in their aligned and clustered form without directly engaging the holes 18, as will be illustrated hereinbelow. The band 12 can also be made to form a loop in many different ways (e.g., the band can be glued, stitched, tied or clipped). Further, the band 12 can be used in connection with many different types of packages or items, such as polybags, paper or cardboard headers or boxes. For example, in FIG. 3, the band 12 is used in connection with polybags 28.

FIGS. 4–21*b* depict additional exemplary embodiments of the present invention. Elements illustrated in FIGS. 4–21*b* which correspond, either identically or substantially, to the elements described above with respect to the embodiment of FIGS. 1 and 2 have been designated by corresponding reference numerals increased by an increment of one hundred in each succeeding embodiment. Unless otherwise stated, the embodiments of FIGS. 4–21*b* is constructed, assembled and used in the same basic manner as the embodiment of FIGS. 1 and 2.

Figure 4:
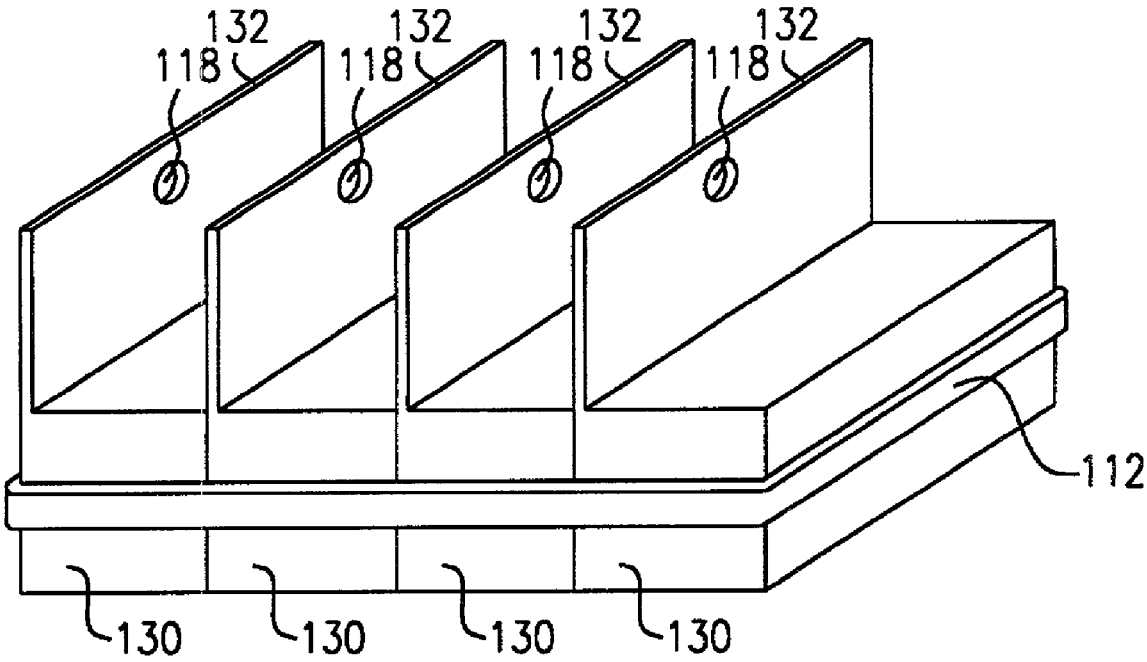
FIG. 4 is a schematic view of a merchandise loading device constructed in accordance with a second embodiment of the present invention.

FIG. 4 shows a band or fastening member 112 constructed in accordance with a second embodiment of the present invention. More particularly, the band 112 is adapted for use in connection with boxes 130 (e.g., boxes for rolls of films) having tags 132 and holes 118 formed in the tags 132. After the holes 118 have been aligned, the band 112 is wrapped around the boxes 130 for substantially immobilizing the boxes 130 with respect to one another. In this manner, the holes 118 are maintained in an aligned orientation so as to facilitate the loading of the boxes 130 onto a peg hook. In this regard, the holes 118 can be made to have a size that is greater than the cross-sectional area of the peg hook by about 10% or greater so as to facilitate the insertion of the peg hook into the holes 118.

Figure 5A:
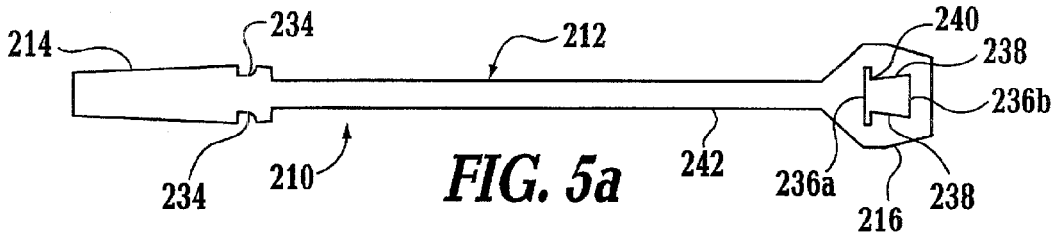
FIG. 5*a* is a plan view of a merchandise loading device constructed in accordance with a third embodiment of the present invention.
Figure 5B:
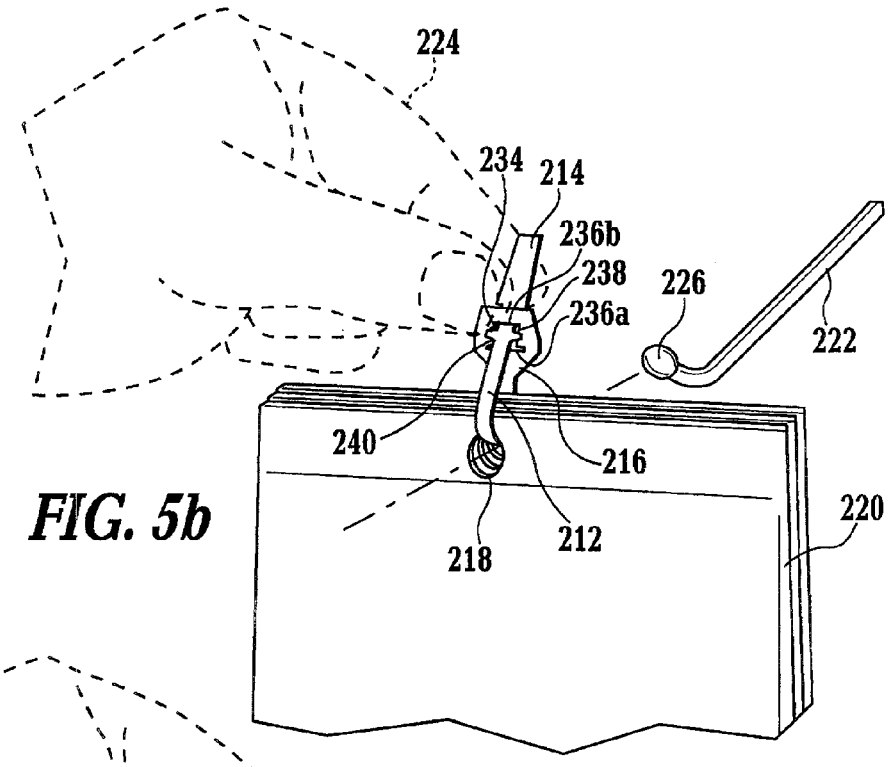
FIGS. 5*b* and 5*c* are schematic views of the loading device shown in FIG. 5*a* during the loading of merchandise packages onto a peg hook.
Figure 5C:
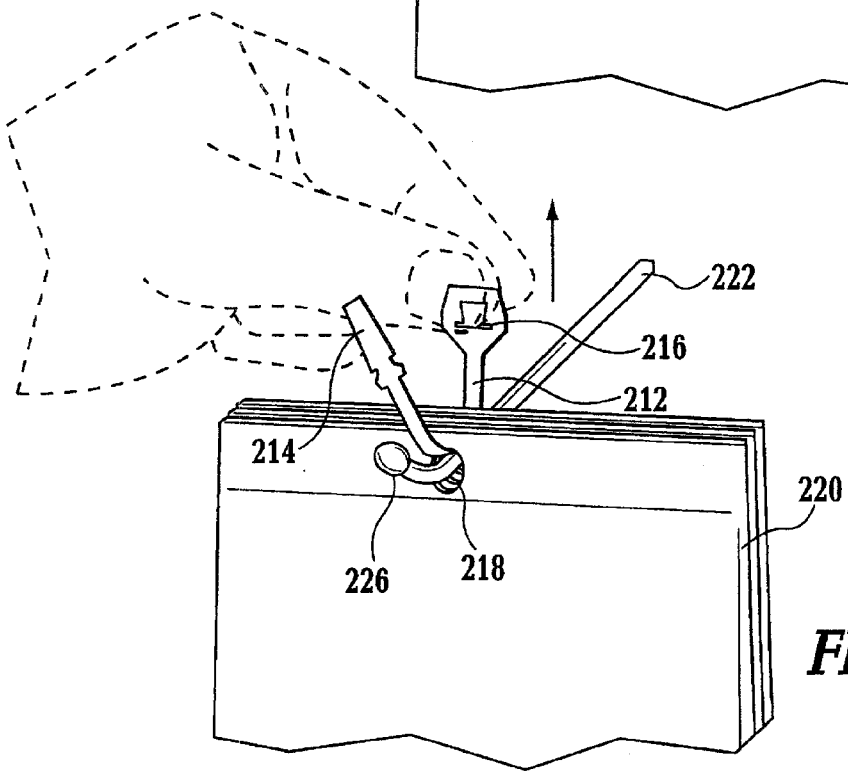

FIGS. 5*a*–5*c* show a merchandise loading/unloading device 210 constructed in accordance with a third embodiment of the present invention. More particularly, the loading device 210, which is made from a band or strip of any suitable materials (e.g., plastic), includes a unitary body 212 having opposing ends 214, 216, which are adapted to be releasably interlocked to one another. In this regard, the end 214 is provided with notches 234, while the end 216 includes a slit 236*a* and an opening 236*b* connected to each other. Tabs 238 extend into the opening 236*b* so as to form a throat 240 between the slit 236*a* and the opening 236*b*. A strip 242, which has a width smaller than those of the ends 214, 216, connects the end 214 to the end 216.

In use, the end 214 is passed through holes 218 of merchandise packages 220 and is then inserted into the slit 236*a*. Thereafter, the end 214 is moved into the opening 236*b* such that the tabs 238 are received in the notches 234 (see FIG. 5*b*). The throat 240 maintains the end 214 releasably locked in the opening 236*b* by way of an interference fit. As a result, the packages 220 are kept as a pre-assembled unit during shipping to a retail outlet. In order to load the packages 220 onto a pegboard display, the end 214 of the loading device 210 is gripped by a user's hand 224 and is then lifted so as to suspend the packages 220 from the loading device 210. Due to gravity, the holes 218 of the packages 220 are automatically aligned with one another and clustered together (see FIG. 5*b*). Next, the holes 218 of the packages 220 are aligned with a free end 226 of a peg hook 222. The free end 226 of the peg hook 222 is then inserted through the holes 18 of the packages 220 by pulling the loading device 210 and hence the entire package unit toward a rear end of the peg hook 222. After all of the packages 220 are loaded onto the peg hook 222, the end 214 of the loading device 210 is unlocked from the end 216 and is then pull out from the holes 218 of the packages 220 (see FIG. 5*c*), releasing the packages 220 from one another to be dispensed individually from the peg hook 222.

Figure 6A:
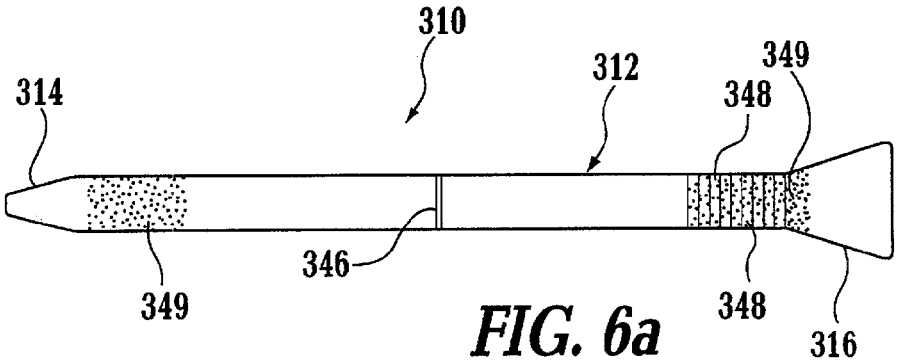
FIG. 6*a* is a plan view of a merchandise loading device constructed in accordance with a fourth embodiment of the present invention.
Figure 6B:
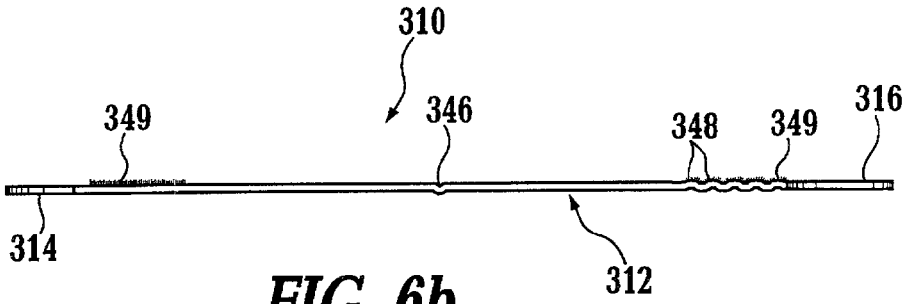
FIG. 6*b* is a side view of the loading device shown in FIG. 6*a;*
Figure 6C:
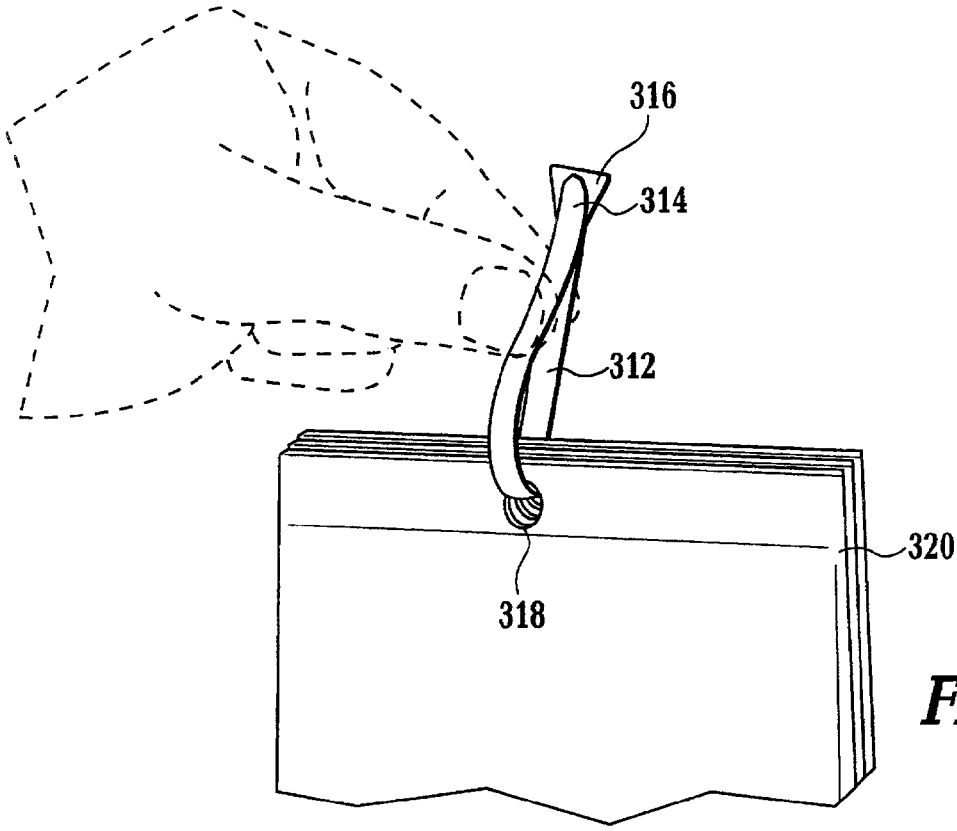
FIG. 6*c* is a schematic view of the loading device of FIGS. 6*a* and 6*b* used for pre-assembling merchandise packages into a shipping and loading unit.

FIGS. 6*a*–6*c* show a merchandise loading/unloading device 310 constructed in accordance with a fourth embodiment of the present invention. The loading device 310 includes a unitary strip 312 having a fold line 346 adjacent a center thereof. The strip 312 has a tapered end 314 and a flared end 316. The flared end 316 has a plurality of crinkles 348 oriented in a direction substantially perpendicular to the longitudinal axis of the strip 312 for purposes to be discussed hereinafter. Pressure-sensitive adhesive materials 349 are applied to one side of the strip at one or both ends 314, 316 so that when the strip 312 is folded along the fold line 346, the tapered and flared ends 314, 316 can removably adhere to each other. In this regard, the adhesive materials 349 can be any conventional pressure-sensitive materials. Alternatively, other adhesive materials or mechanisms can be used. The strip 312 is made from a chipboard material and has a strength sufficient to support merchandise packages 320 (see FIG. 6*c*) therefrom while loading. Alternatively, the strip 312 can be made from other suitable materials, such as paper, plastic, metal, etc.

With reference to FIG. 6*c*, after the strip 312 is inserted through holes 318 of the packages 320, the tapered and flared ends 314, 316 are pressed to one another so as to be removably attached to each other. While being maintained as a pre-assembled unit by the strip 312, the packages 320 are shipped to a retail outlet or store. After the loading of the packages 320 onto a peg hook, the flared end 316 is gripped by a user and then pulled away from the tapered end 314. Because of the crinkles 348, the flared end 316 curls away from the tapered end 314 and is hence easily detached from same in a "peeling" motion. In this regard, the amount of the adhesive materials 349 applied to the strip 312 should be sufficient to maintain the packages 320 as an assembled unit during shipping, while permitting easy manual peeling of the flared end 316 from the tapered end 314 subsequent to the loading of the packages 320 onto the peg hook. After detaching the flared end 316 from the tapered end 314, the strip 312 is removed from the packages 320.

Figure 7A:
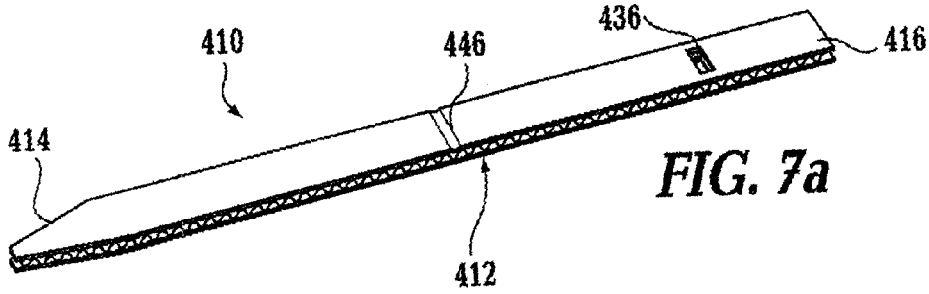
FIG. 7*a* is a perspective view of a merchandise loading device constructed in accordance with a fifth embodiment of the present invention.
Figure 7B:
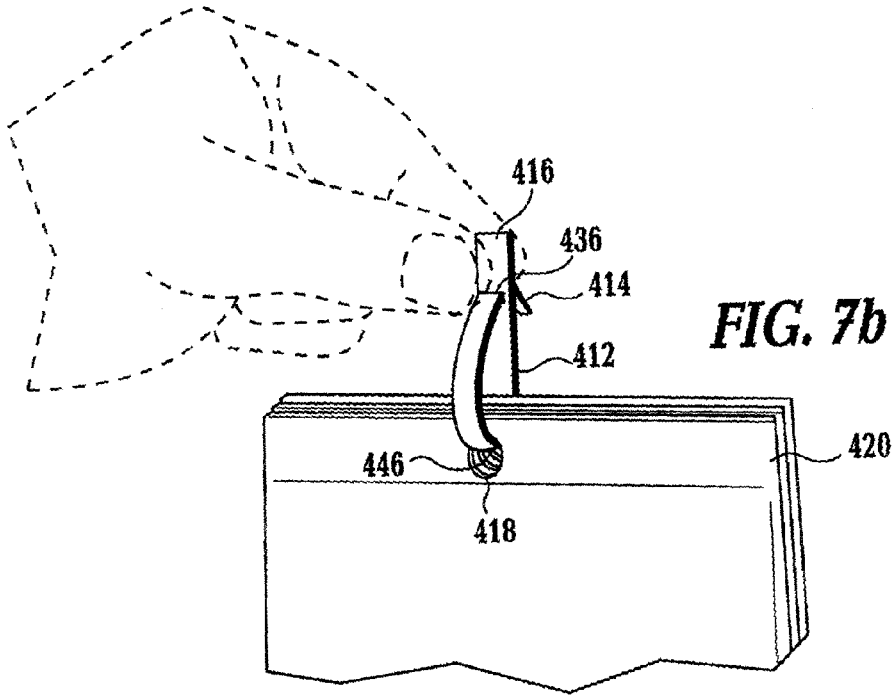
FIG. 7*b* is a schematic view of the loading device of FIG. 7*a* used for pre-assembling merchandise packages into a shipping and loading unit.

FIGS. 7*a* and 7*b* show a merchandise loading/unloading device 410 constructed in accordance with a fifth embodiment of the present invention. The loading device 410 includes a strip 412 having a pair of ends 414, 416 and a fold line 446 therebetween. The end 414 is tapered, while the end 416 has a slit 436 formed therein. The end 414 is sized and shaped so as to be removably received in the slit 436 so as to form a "locking" loop for merchandise packages 420 (see FIG. 7*b*). In this regard, the strip 412 is made from a material having a suitable strength and rigidity, such as cardboard.

In order to pre-assemble the packages 420 into a shipping and loading unit, the strip 412 is inserted through holes 418 of the packages 420 and folded along the fold line 446. The tapered end 414 is then inserted into the slit 436 (see FIG. 7*b*). After the loading of the packages 420 onto a peg hook, the end 414 is pulled out from the slit 436, and the strip 412 is removed from the packages 420.

Figure 8A:
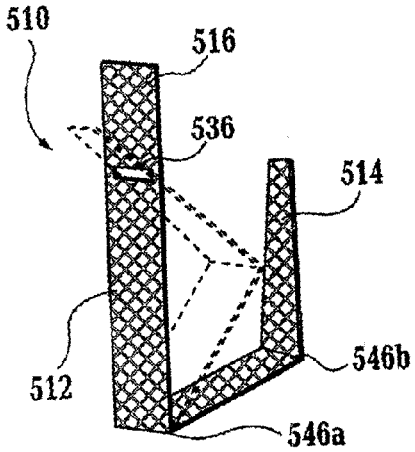
FIG. 8*a* is a perspective view of a merchandise loading device constructed in accordance with a sixth embodiment of the present invention.
Figure 8B:
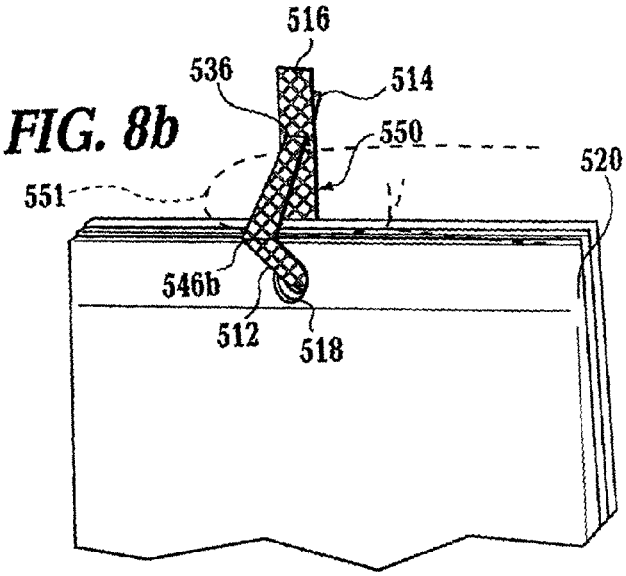
FIG. 8*b* is a schematic view of the loading device of FIG. 8*a* used for pre-assembling merchandise packages into a shipping and loading unit.

With reference to FIGS. 8*a* and 8*b*, there is shown a merchandise loading/unloading device 510 constructed in accordance with a sixth embodiment of the present invention. The loading device 510 includes a strip 512 having a pair of opposing ends 514, 516. The end 514 is tapered, while the end 516 has a slit 536 sized and shaped so as to receive the tapered end 514 for interlocking the ends 514, 516 to each other by way of a frictional or mechanical fit. The strip 512 has a fold line 546*a* located adjacent the center of the strip 512 and a fold line 546*b* located between the fold line 546*a* and the end 514.

Referring to FIG. 8*b*, after the end 514 of the strip 512 is passed through holes 518 of merchandise packages 520, the strip 512 is folded along the fold lines 546*a*, 546*b*. The end 514 is then inserted into the slit 536 so as to form a triangular loop 550. In this regard, the strip 512 is provided with sufficient stiffness for maintaining its triangular loop 550. For instance, the strip 512 can be made from a material similar to stiff plastic strips used for packaging oversized packages. Alternatively, the strip 512 can be made from corrugated materials, such as those known as "Eflute" and "Fflute". Because the triangular loop 550 is maintained by the engagement of the end 514 with the slit 536, the end 514 is provided with a length sufficient to prevent accidental disengagement of the end 514 from the slit 536 during the shipping of the packages 520. After the packages 520 are loaded onto a peg hook as a unit (using one or both of the ends 514, 516 as a handgrip), a user's finger 551 is inserted into an opening formed by the loop 550 (see FIG. 8*b*), and the end 514 is pulled out from the slit 536 by the finger 551. The strip 512 is then removed from the packages 520.

Figure 9A:
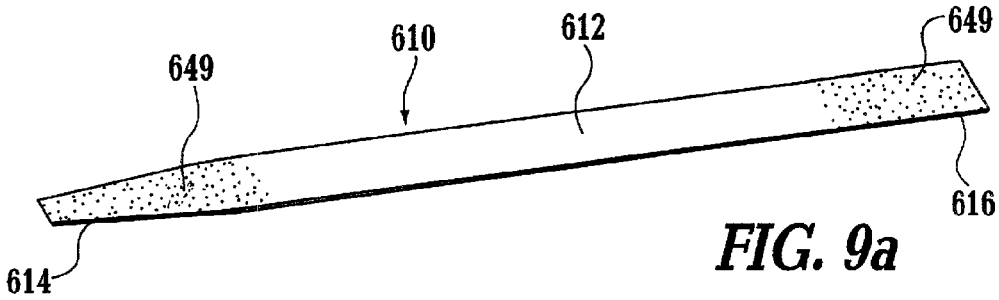
FIG. 9*a* is a perspective view of a merchandise loading device constructed in accordance with a seventh embodiment of the present invention.
Figure 9B:
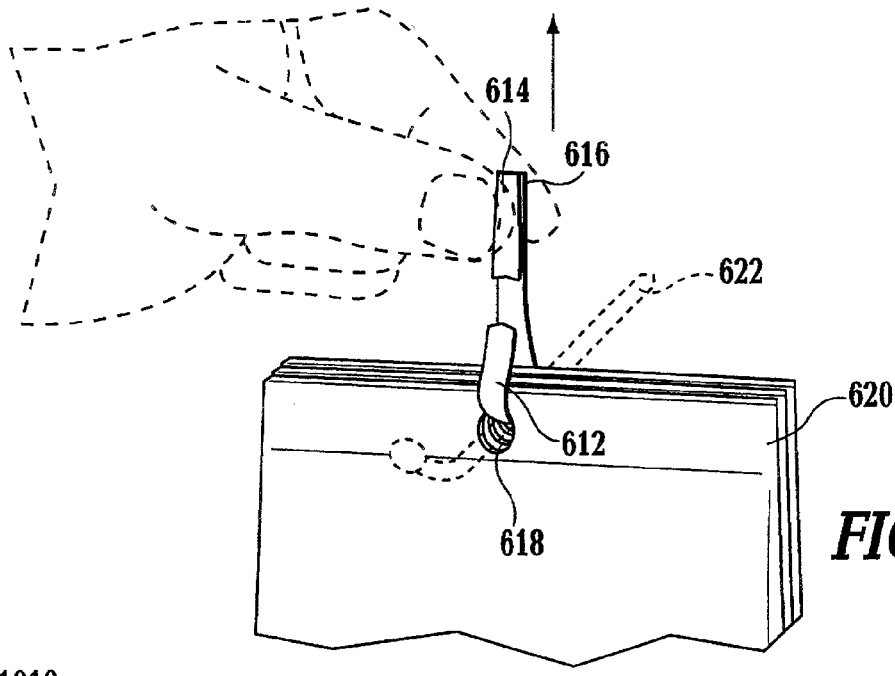
FIG. 9*b* is a schematic view of the loading device of FIG. 9*a* during the loading of merchandise packages onto a peg hook.

FIGS. 9*a* and 9*b* show a merchandise loading/unloading device 610 constructed in accordance with a seventh embodiment of the present invention. The loading device 610 includes a strip 612 made from paper. Pressure-sensitive adhesive materials 649 are applied to one side of the strip 612 at ends 614, 616 thereof. After the strip 612 is inserted through holes 618 of packages 620, the ends 614, 616 are brought together and pressed against one another for attachment. The adhesive materials 649 should have a sufficient bonding strength so as to prevent the packages 620 from being released from one another during shipping or storage. After the packages 620 are loaded onto a peg hook, the strip 612 is torn or otherwise disabled so as to permit withdrawal of the strip 612 from the packages 620 (see FIG. 9*b*). In this regard, the loop formed by the strip 612 can be sized and shaped to receive a person's finger. In this manner, the strip 612 can be torn after the loading of the packages 620 onto a peg hook by inserting a finger into the loop and pulling the strip 612.

Figure 10A:
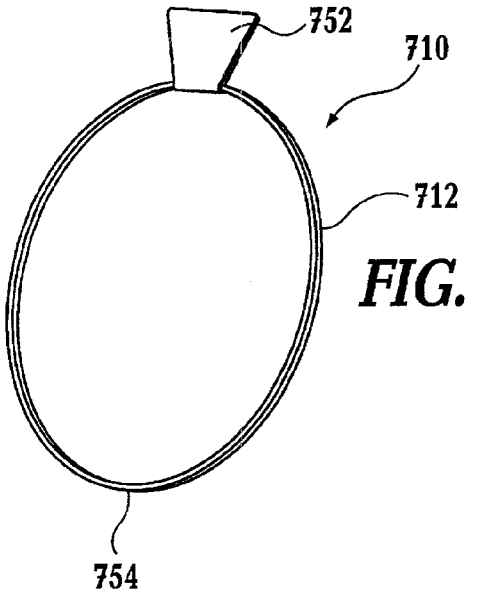
FIG. 10*a* is a perspective view of a merchandise loading device constructed in accordance with an eighth embodiment of the present invention.
Figure 10B:
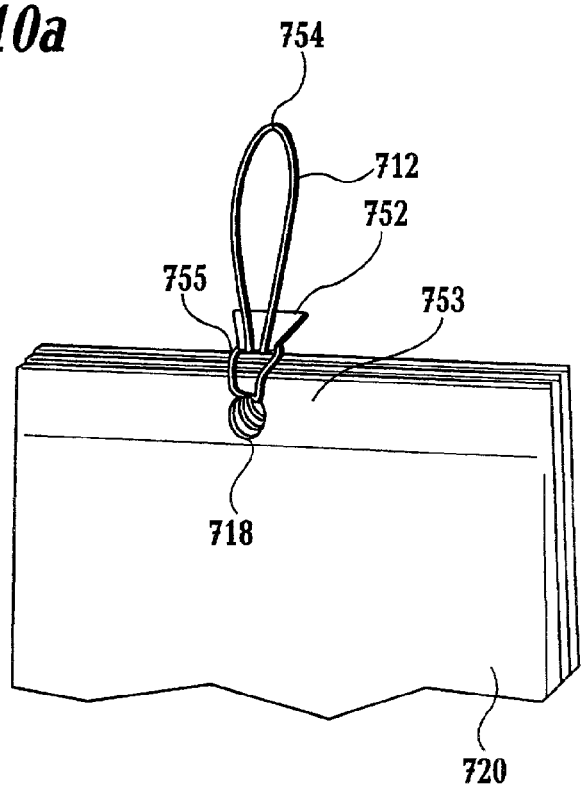
FIGS. 10*b* and 10*c* are schematic views of the loading device shown in FIG. 10*a* during the loading of merchandise packages onto a peg hook.
Figure 10C:
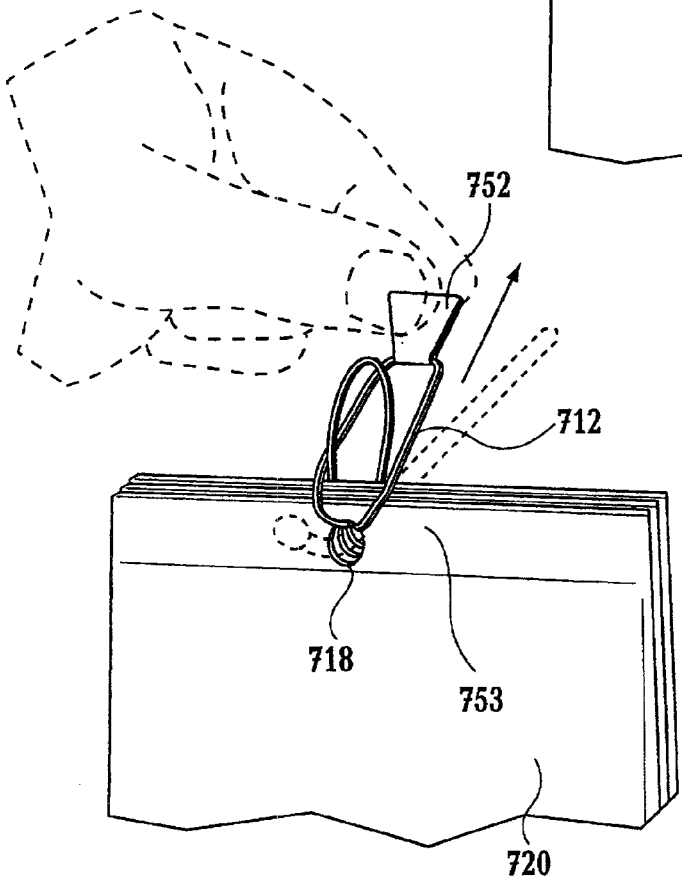

Now referring to FIGS. 10*a*–10*c*, a merchandise loading/unloading device 710, which is constructed in accordance with an eighth embodiment of the present invention, includes a rubber band 712 and a tab 752 fixedly attached to the rubber band 712. Alternatively, the tab 752 can be completely eliminated or replaced with other mechanisms.

In order to pre-assemble merchandise packages 720 into a shipping and/or loading unit, the rubber band 712 is releasably tied around upper end 753 of the packages 720. More particularly, a portion 754 of the rubber band 712 located opposite the tab 752 is passed through holes 718 of the packages 720. The portion 754 is then passed through the rubber band 712 and pulled out so as to form a releasable knot 755 tying the upper ends 753 of the packages 720 to one another (see FIG. 10*b*). Due to the elasticity of the rubber band 712, the knot 755 is maintained such that the packages 720 are kept as an assembled unit during shipping. After the packages 720 are loaded onto a peg hook (using the portion 753 as a handgrip), the tab 752 is gripped by a user and is then pulled so as to untie the knot 755 (as indicated by the arrow in FIG. 10*c*). In this manner, the loading device 710 can be quickly released from the packages 720 subsequent to loading.

It should be noted that the rubber band 712 can be replaced with bands made from other materials. For instance, the band 712 can be made from any rubber-like natural or synthetic materials, plastics, textile materials coated with rubber or latex materials, etc. Regardless of the material used for making the band 712, the band 712 should preferably be provided with a sufficient coefficient of elasticity or friction so as to maintain the knot 755 during the shipping of the packages 720 to a retail outlet.

Figure 11A:
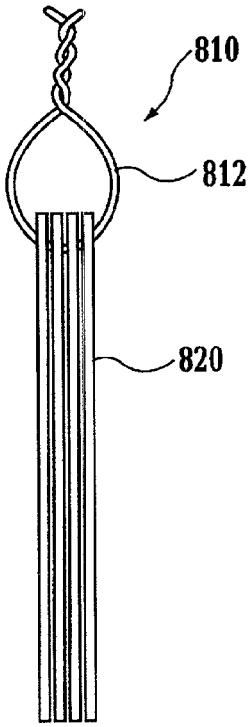
FIGS. 11*a* and 11*b* are schematic views of a merchandise loading device constructed in accordance with a ninth embodiment of the present invention.
Figure 11B:
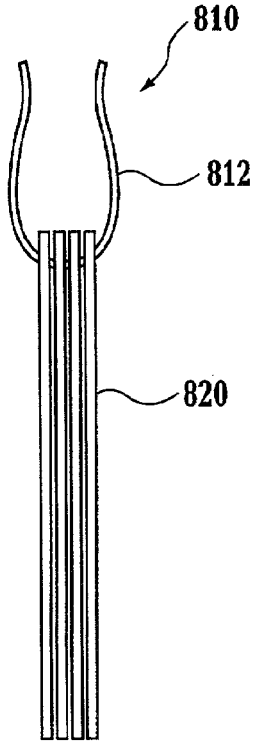

FIGS. 11*a* and 11*b* show a merchandise loading/unloading device 810 constructed in accordance with a ninth embodiment of the present invention. More particularly, the loading device 810 is in the form of a twist tie 812. The twist tie 812 is used to tie packages 820 into a pre-assembled unit for shipping and loading. After the packages 820 are loaded onto a peg hook (using the twisted ends as a handgrip), the twist tie 812 is untied (see FIG. 11*b*) and withdrawn from the packages 820.

Figure 12A:
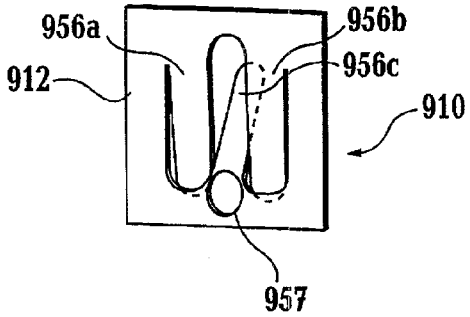
FIG. 12*a* is a perspective view of a merchandise loading device constructed in accordance with a tenth embodiment of the present invention.
Figure 12B:
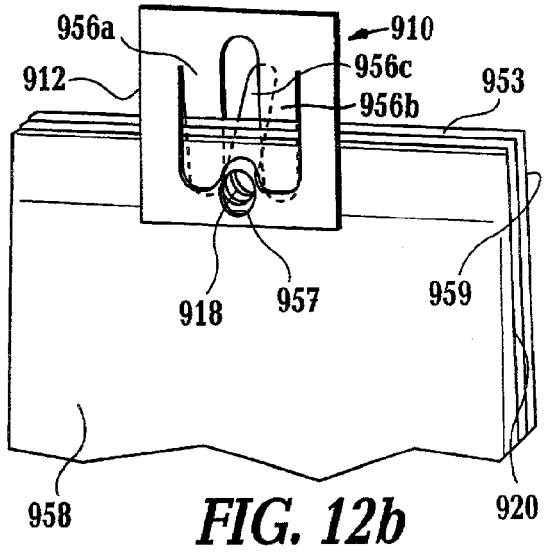
FIGS. 12*b* and 12*c* are schematic views of the loading device shown in FIG. 12*a* during the loading of merchandise packages onto a peg hook.
Figure 12C:
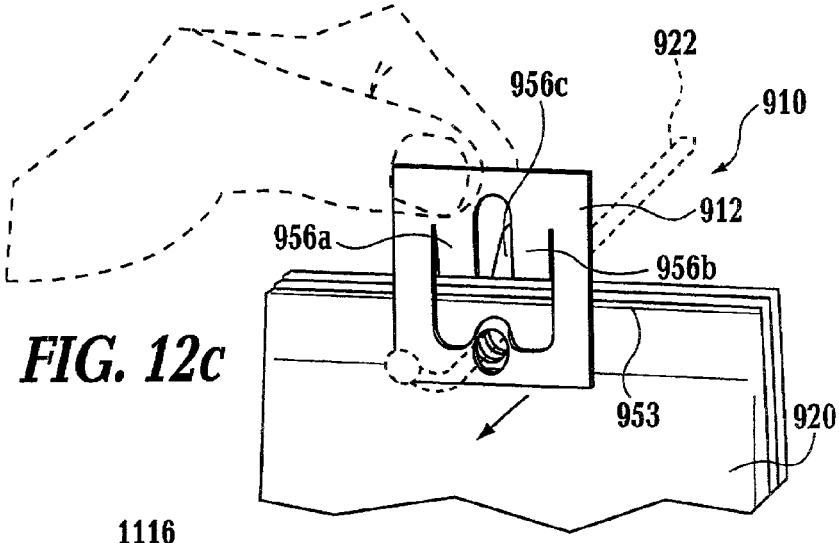

With reference to FIGS. 12*a* and 12*b*, a merchandise loading/unloading device 910 constructed in accordance with a tenth embodiment of the present invention includes a unitary, flexible plastic body 912. Alternatively, the body 912 can be made from other suitable materials, such as paper, rubber, metal, etc. The body 912 includes a pair of fingers 956*a*, 956*b*, which project in one direction, and a finger 956*c*, which projects in an opposite direction. The finger 956*c* is positioned between the fingers 956*a*, 956*b*. An opening 957 is also formed in the body 912 below the finger 956*c* for purposes to be discussed hereinafter. The body 912 has a perimeter which forms a closed loop.

In order to assemble packages 920 into a shipping and loading unit, with the body 912 positioned on a front side 958 of the packages 920, the finger 956*c* is inserted through holes 918 of the packages 920 and placed on a rear side 959 of same. The fingers 956*a*, 956*b* are also placed over upper ends 953 of the packages 920 and are positioned on the rear side 959 (see FIG. 12*b*). As a result, the upper ends 953 of the packages 920 are retained by the fingers 956*a*–956*c*, thereby maintaining the packages 920 as an assembled unit for shipping and loading. When properly assembled, the holes 918 of the packages 920 align with the opening 957 of the body 912 so as to permit the loading of the packages 920 onto a peg hook 922 together with the loading device 910. After the packages 920 are loaded onto the peg hook 922 (see FIG. 12*c*), the loading device 910 is pulled in a forward direction (as indicated by the arrow in FIG. 12*c*). Due to the flexibility of the loading device 910, the fingers 956*a*–956*c* bend so as to permit quick release of the loading device 910 from the packages 920.

Figure 13A:
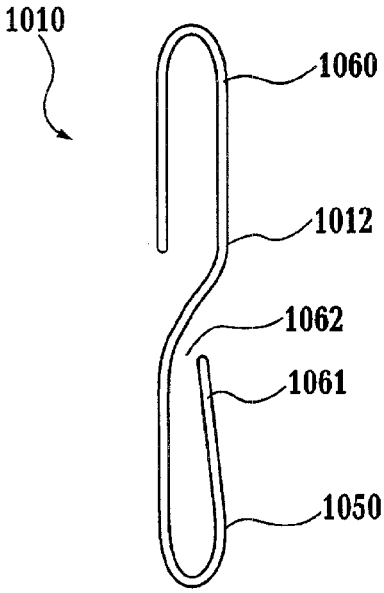
FIG. 13*a* is a perspective view of a merchandise loading device constructed in accordance with an eleventh embodiment of the present invention.
Figure 13B:
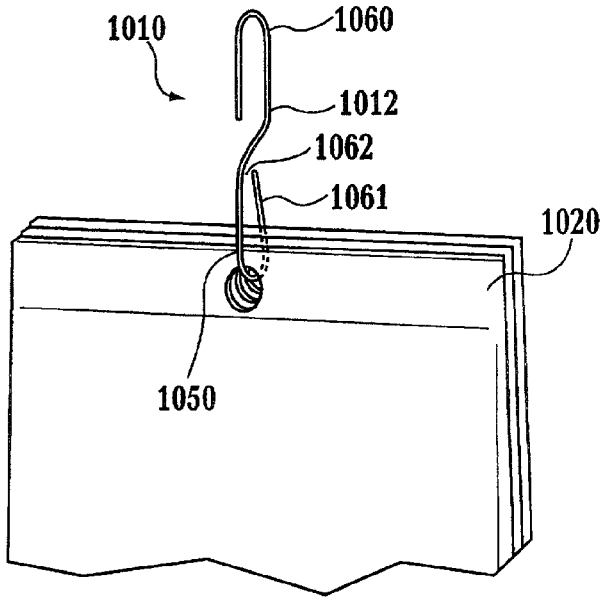
FIG. 13*b* is a schematic view of the loading device of FIG. 13*a* used for pre-assembling merchandise packages into a shipping and loading unit.

Now referring to FIGS. 13*a* and 13*b*, there is shown a merchandise loading/unloading device 1010 constructed in accordance with an eleventh embodiment of the present invention. The loading device 1010 has a unitary wire-like body 1012 made from metal and bent into a predetermined shape so as to form a U-shaped loop 1050 at one end thereof and an inverted U-shaped loop 1060 at an opposite end thereof. The loop 1050 includes a free end 1061 spaced from the body 1012 to form a gap 1062 (i.e., the loop 1050 is open).

In use, packages 1020 are loaded onto the loop 1050 (see FIG. 13*b*). Because the gap 1062 is relatively small, it inhibits the release of the packages 1020 from the loop 1050 during shipping. With the loop 1060 used as a handgrip, the packages 1020 are loaded onto a peg hook. After loading, the packages 1020 are removed from the loading device 1010 through the gap 1062.

Figure 14A:
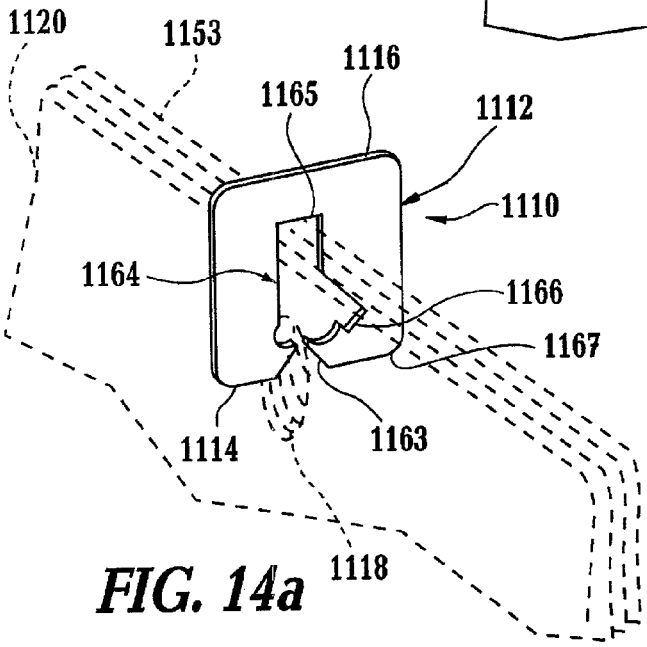
FIGS. 14*a* and 14*b* are schematic views of a merchandise loading device constructed in accordance with a twelfth embodiment of the present invention.
Figure 14B:
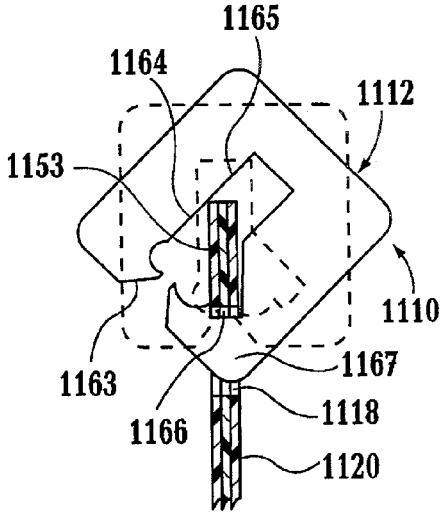

With reference to FIGS. 14*a* and 14*b*, a merchandise loading/unloading device 1110 constructed in accordance with a twelfth embodiment of the present invention is shown. The loading device 1110 includes a substantially flat body 1112 having an upper end 1116 and a lower end 1114. The body 1112 is made from a relatively stiff material, such as a plastic. A V-shaped notch 1163 is formed in the lower end 1114 of the body 1112, while an opening 1164 is formed in the body 1112 between the upper and lower ends 1116, 1114 and connected to the notch 1163. The opening 1164 is sized and shaped so as to receive upper portions 1153 of merchandise packages 1120. More particularly, the opening 1164 has an upper section 1165, which extends toward the upper end 1116 of the body 1112, and a lateral section 1166, which extends at an angle with respect to the upper section 1165. The loading device 1110 also has a corner 1167 located adjacent to the lateral section 1166 of the opening 1164, as well as a perimeter forming an open loop.

In use, the upper portions 1153 of the packages 1120 are inserted into the notch 1163. Due to the V-shape of the notch 1163, the upper portions 1153 of the packages 1120 are funneled into the opening 1164. When the upper package portions 1153 are placed in the opening 1164 (see the broken line representation of the body 1112 in FIG. 14*b*), the body 1112 is pivoted such that the notch 1163 moves away from the upper package portions 1153 so as to prevent same from being released from the opening 1164 (see the solid line representation of the body 1112 in FIG. 14*b*). More particularly, the upper package portions 1153 are positioned in the lateral section 1166 and the upper section 1165 of the opening 1164, while the corner 1167 of the body 1112 is placed in holes 1118 of the packages 1120. As a result, the body 1112 is inhibited from moving relative to the packages 1120 so as to maintain same as a unit during shipping and loading. After the packages 1120 are loaded onto a peg hook (using the corner diagonally opposite the corner 1167 as a handgrip), the body 1112 is pivoted back to its original position (see the broken line representation of the body 1112 in FIG. 14*b*) and is then removed from the packages 1120. For instance, after the body 1112 is pivoted back to its original position, it can be twisted so as to increase the size of the notch 1163 for facilitating the removal of the upper package portions 1153 from the opening 1164.

Figure 15:
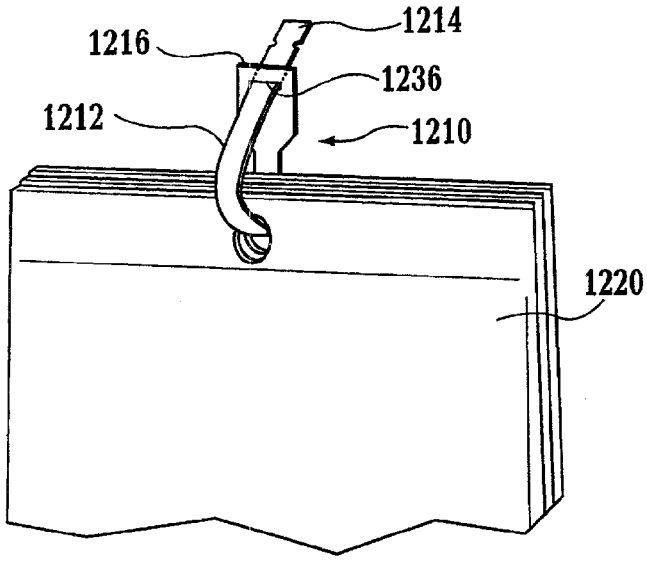
FIG. 15 is a schematic view of a merchandise loading device constructed in accordance with a thirteenth embodiment of the present invention.

A merchandise loading/unloading device 1210 constructed in accordance with a thirteenth embodiment of the present invention is shown in FIG. 15. The loading device 1210 includes a strip 1212 made from a chipboard material and coated with polyester to strengthen the strip 1212. The strip 1212 has a pair of ends 1214, 1216. The end 1216 has a slit 1236 sized and shaped so as to receive the end 1214 for assembling a set of merchandise packages 1220 into a shipping and loading unit.

Figure 16:
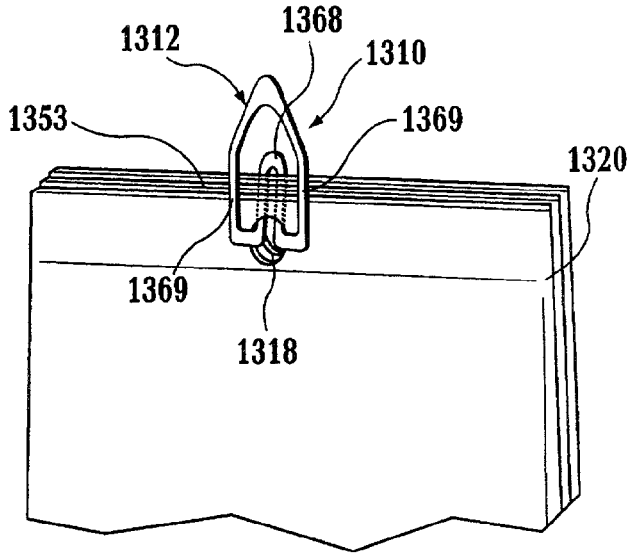
FIG. 16 is a schematic view of a merchandise loading device constructed in accordance with a fourteenth embodiment of the present invention.

FIG. 16 shows a merchandise loading/unloading device 1310 constructed in accordance with a fourteenth embodiment of the present invention. The loading device 1310 has an integral body 1312 having a closed loop construction and including a tongue 1368 and a pair of legs 1369 interconnected to the tongue 1368. The tongue 1368 is sized and shaped so as to be inserted through holes 1318 of merchandise packages 1320. The tongue 1368 also has a sufficient resiliency such that upper portions 1353 of the packages 1320 can be gripped by the tongue 1368 and the legs 1369 for maintaining the packages 1320 as a shipping and loading unit. In loading the packages 1320 onto a peg hook, an upper edge of the loading device 1310 can be used as a handgrip.

Figure 17:
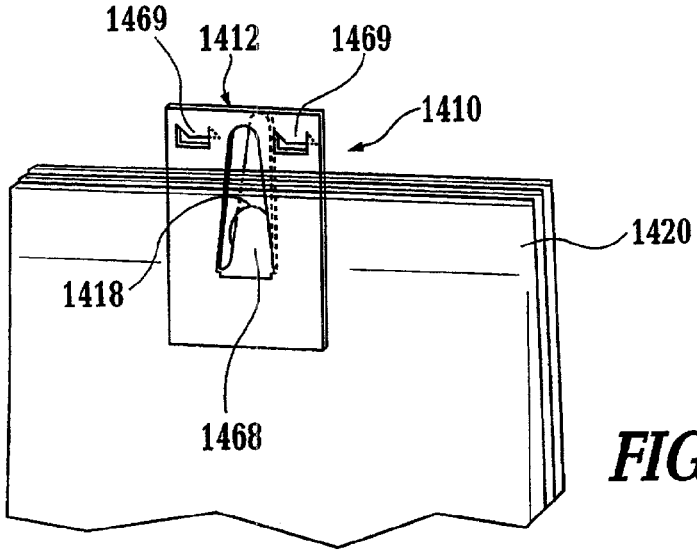
FIG. 17 is a schematic view of a merchandise loading device constructed in accordance with a fifteenth embodiment of the present invention.

Now referring to FIG. 17, a merchandise loading/unloading device 1410 constructed in accordance with a fifteenth embodiment of the present invention has a rigid body 1412 made from plastic. Alternatively, other types of material can be used for the body 1412. A tongue 1468 projects from the body 1412 in one direction, while tabs 1469 project from the body 1412 in an opposite direction. The tongue 1468 is sized and shaped so as to be inserted through holes 1418 of merchandise packages 1420 to be assembled into a shipping and loading unit. The tabs 1469 are adapted to inhibit the body 1412 from being released from the packages 1420 during shipping. In loading the packages 1420 onto a display peg, an upper edge of the body 1412 can be used as a handgrip. The body 1412 also has a perimeter forming a closed loop.

Figure 18:
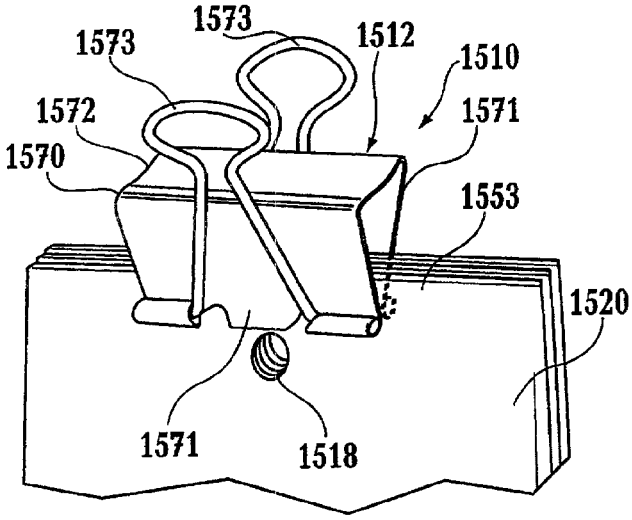
FIG. 18 is a schematic view of a merchandise loading device constructed in accordance with a sixteenth embodiment of the present invention.

FIG. 18 shows a merchandise loading/unloading device 1510 constructed in accordance with a sixteenth embodiment of the present invention. The loading device 1510 is in the form of a binding clip 1512 similar, in construction, to a conventional binding clip. For instance, the clip 1512 has a unitary metal body 1570, which forms a closed loop and which has a pair of legs 1571. A spring member 1572 is connected to the legs 1571 so as to urge the legs 1571 against one another. Grip members 1573 are coupled to the legs 1571 for use in releasing same from one another. One or both of the grip members 1573 can also be used as a handgrip in loading merchandise packages 1520 onto a peg hook.

In use, the clip 1512 is mounted to upper portions 1553 of the packages 1520. More particularly, after the packages 1520 are arranged such that holes 1518 of the packages 1520 are aligned with each another and clustered together, the clip 1512 is mounted to the upper portions 1553 so as to immobilize same with respect to one another. In this manner, while the clip 1512 is mounted above the holes 1518 and does not hence directly interact or engage with same, the holes 1518 remain aligned and clustered during shipping and loading.

Figure 19A:
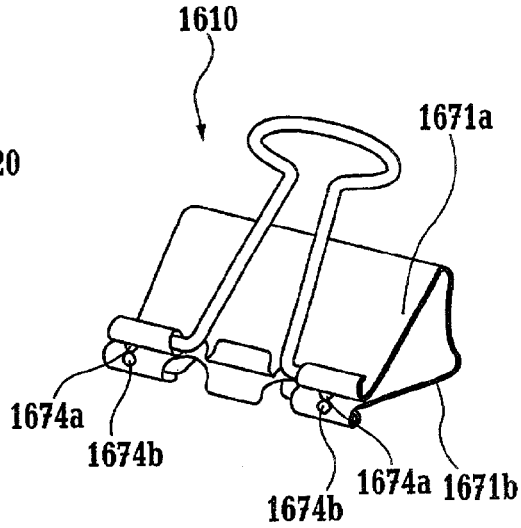
FIG. 19*a* is a perspective view of a merchandise loading device constructed in accordance with a seventeenth embodiment of the present invention.

FIG. 19*a* shows a merchandise loading/unloading device 1610 constructed in accordance with a seventeenth embodiment of the present invention. The loading device 1610 is identical to the loading device 1510 of FIG. 18, except as discussed hereinbelow. The loading device 1610 has a pair of legs 1671*a*, 1671*b*. Tabs 1674*a* project from the leg 1671*a*, while tabs 1674*b* project from the leg 1671*b*. The tabs 1674*a*, 1674*b* are positioned such that when the loading device 1610 is in its closed position (i.e., when the legs 1671*a*, 1671*b* are urged against each other), each of the tabs 1674*a* engages a corresponding one of the tabs 1674*b*.

Figure 19B:
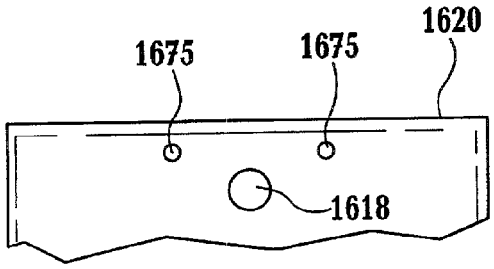
FIG. 19*b* is a sectional view of a merchandise package adapted for use in conjunction with the loading device of FIG. 19*a;*
Figure 19C:
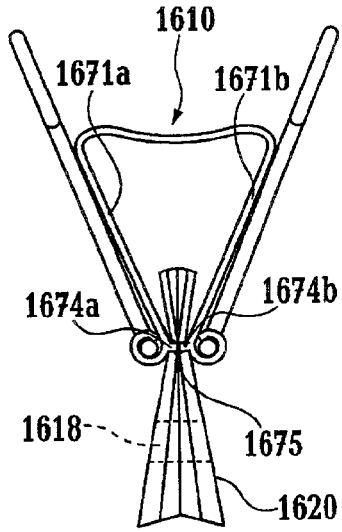
FIG. 19*c* is a schematic view of the loading device of FIG. 19*a* clipped to merchandise packages.

The loading device 1610 is adapted for use in connection with merchandise packages 1620 having openings 1675 in addition to mounting holes 1618 (see FIG. 19*b*). The openings 1675 are located above the holes 1618. The openings 1675 are sized and shaped such that when the loading device 1610 is mounted to the packages 1620, the tabs 1674*a* can engage the tabs 1674*b* through the openings 1675 (see FIG. 19*c*). In this manner, the tabs 1674*a*, 1674*b* inhibit the packages 1620 from being released accidentally from the loading device 1610.

Figure 20:
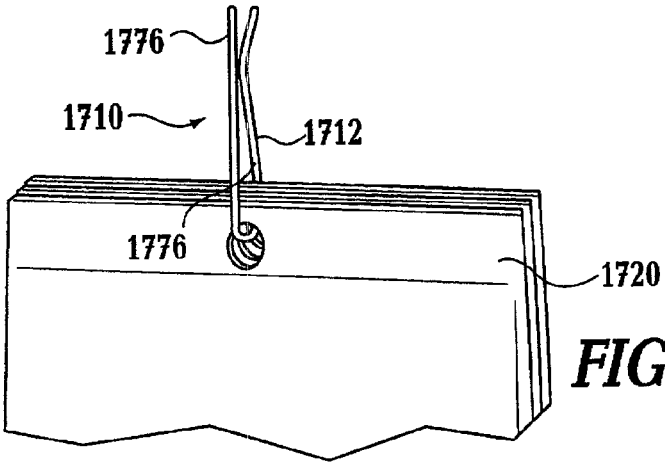
FIG. 20 is a schematic view of a merchandise loading device constructed in accordance with an eighteenth embodiment of the present invention.

FIG. 20 shows a merchandise loading/unloading device 1710 constructed in accordance with an eighteenth embodiment of the present invention. The loading device 1710 has a construction similar to that of a conventional bobby pin. More particularly, the loading device 1710 has a unitary wire-like body 1712 having a pair of legs 1776, at least one of which is long enough to function as a handgrip. The legs 1776 converge adjacent free ends thereof so as to restrict packages 1720 from being released accidentally during shipping. The body 1712 also forms an open loop.

Figure 21A:
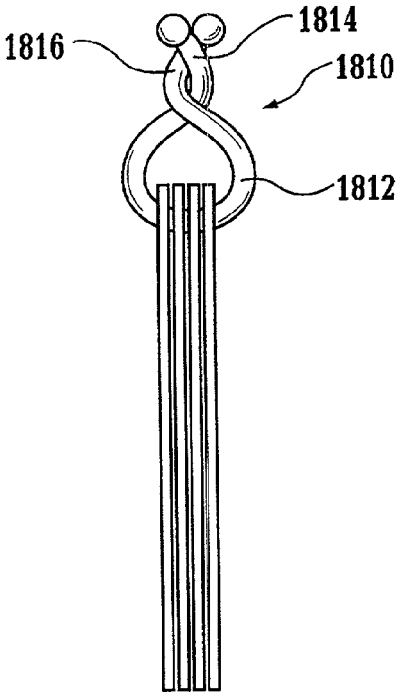
FIGS. 21*a* and 21*b* are schematic views of a merchandise loading device constructed in accordance with a nineteenth embodiment of the present invention.
Figure 21B:
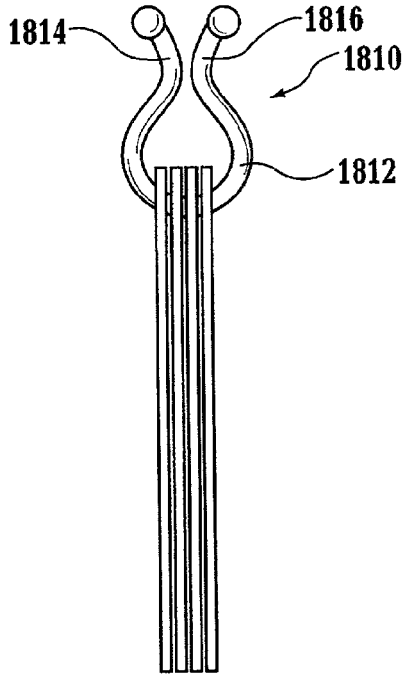

Now referring to FIGS. 21*a* and 21*b*, a merchandise loading/unloading device 1810 constructed in accordance with a nineteenth embodiment of the present invention includes a unitary horseshoe-shaped body 1812 having ends 1814, 1816. The ends 1814, 1816 are adapted to be releasably interlocked with one another so as to form a closed loop, as well as a handgrip. While the body 1812 is preferably made from a flexible plastic material, other materials can be used.

It should be noted that the present invention can have further modifications and variations in addition to those discussed above. For instance, two or more of the devices of the embodiments shown in FIGS. 1–21*b* can be used in conjunction with one another to load packages onto a display peg. By way of example, each of the devices 510, 610 of the embodiments shown in FIGS. 5*a*–6*c* can be inserted through one of the openings 1675 of the packages 1620 illustrated in FIG. 19*b* to form an assembled unit of packages. The devices 510 and 610 can be made as separate pieces or as an integral piece. Two or more pieces of an identical loading device can also be used simultaneously.

It will be understood that the embodiments described herein are merely exemplary and that a person skilled in the art may make many variations and modifications without departing from the spirit and scope of the invention. All such variations and modifications, including those mentioned above, are intended to be included within the scope of the invention as defined in the appended claims.

I claim:

1. In combination, a plurality of packages, each of which includes a hanging hole; and a device for holding and facilitating the unloading therefrom of said packages onto a display peg, said device including a carrier for holding said packages together, said carrier having a first section proximate one end thereof, a second section, which is positioned remote from said first section, and a third section, which interconnects said first section to said second section and which is formed monolithically with said first and second sections, at least one of said first and second sections passing through said hanging holes of said packages, said third section and at least one of said first and second sections being flexible such that said first section is engaged with said second section so as to form a loop which gathers said packages into a group for permitting said packages to be applied to the display peg with the aid of said carrier, at least a portion of said packages being positioned within said loop.

2. The combination of claim 1, wherein said first section is releasably attached to said second section such that said carrier can be removed from the gathered packages after the gathered packages are applied to a display peg, whereby the gathered packages are released onto the display peg for individual dispensing therefrom.

3. The combination of claim 2, wherein at least one of said first and second sections includes a handle member sized and shaped so as to permit said carrier to be gripped by a user for manual application to a display peg.

4. A combination according to claim 3, wherein said first and second sections are releaseably attached to each other by a fastener member.

5. A combination according to claim 4, wherein said fastener member is a staple.

6. A combination according to claim 3, wherein said first and second sections are releaseably attached to each other by adhesion.

7. A combination according to claim 3, wherein said carrier includes at least one fold line intermediate said first and second sections.

8. A combination according to claim 3, wherein said loop is a closed loop made from a material having sufficient elasticity to permit said closed loop to be tied into a knot to thereby form said loop.

9. A combination according to claim 8, wherein said closed loop is a rubber band having a tab attached thereto, said tab facilitating the unknotting of said loop.

10. A combination according to claim 3, wherein said carrier is made from a twist tie, whereby said first and second sections can be twisted about each other.

11. A combination according to claim 10, wherein said first and second sections form said handle member.

12. A combination according to claim 3, wherein said carrier is made from a horseshoe-shaped element having sufficient resiliency such that said first and second sections can be crossed over each other, whereby they are releaseably interlocked.

13. A combination according to claim 12, wherein said crossed-over first and second sections of said horseshoe-shaped element form said handle member.

14. The combination of claim 3, wherein said carrier includes guiding means for guiding said carrier onto a display peg.

15. The combination of claim 3, wherein one of said first and second sections is sized and shaped so as to extend through an opening in said carrier to thereby form said loop.

16. The combination of claim 15, wherein said opening is formed in the other of said first and second sections.

17. The combination of claim 16, wherein said one of said first and second sections extends through said opening far enough to form said handle member.

18. The combination of claim 17, wherein said first and second sections are releaseably interlocked to each other by an interference fit.

19. A combination according to claim 15, wherein said carrier has an opposite end, said second section being positioned adjacent said opposite end of said carrier, said opening being formed intermediate said one end and said opposite end of said carrier.

20. A combination according to claim 19, wherein said opening is spaced far enough from said opposed end of said carrier such that said opposed end forms said handle member.

21. A combination according to claim 20, wherein said one of said first and second sections is releaseably retained within said opening by friction.

22. A combination according to claim 21, wherein said carrier includes at least one fold line intermediate said one end and said opposed end of said carrier, said at least one fold line facilitating the formation of said loop.

23. A combination according to claim 22, wherein said at least one fold line includes a first fold line and a second fold line, said first and second fold lines cooperating to impart a triangular shape to said loop.

24. The combination of claim 3, wherein a portion of said loop functions as said handle member.

* * * * *